US008540524B2

(12) United States Patent
Cai et al.

(10) Patent No.: US 8,540,524 B2
(45) Date of Patent: Sep. 24, 2013

(54) ELECTRICAL CONNECTOR

(75) Inventors: Chao Wen Cai, Guangzhou (CN); Yong Quan Wu, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 8 days.

(21) Appl. No.: 13/444,407

(22) Filed: Apr. 11, 2012

(65) Prior Publication Data

US 2013/0210263 A1 Aug. 15, 2013

(30) Foreign Application Priority Data

Feb. 9, 2012 (CN) ..... 2012 2 0040505 U

(51) Int. Cl.
*H01R 12/00* (2006.01)

(52) U.S. Cl.
USPC ..... 439/76.1

(58) Field of Classification Search
USPC ..... 439/76.1, 630, 326, 341, 342
See application file for complete search history.

(56) References Cited

U.S. PATENT DOCUMENTS

| | | | | |
|---|---|---|---|---|
| 5,603,629 | A * | 2/1997 | DeFrasne et al. | 439/331 |
| 5,933,328 | A * | 8/1999 | Wallace et al. | 361/737 |
| 6,210,193 | B1 * | 4/2001 | Ito et al. | 439/326 |
| 6,220,882 | B1 * | 4/2001 | Simmel et al. | 439/326 |
| 7,063,552 | B2 * | 6/2006 | Matsunaga et al. | 439/326 |

* cited by examiner

*Primary Examiner* — Tulsidas C Patel
*Assistant Examiner* — Phuongchi T Nguyen
(74) *Attorney, Agent, or Firm* — Morris Manning & Martin LLP; Tim Tingkang Xia, Esq.

(57) ABSTRACT

An electrical connector for electrically connecting a mating element to a motherboard includes an insulating body having two side surfaces disposed symmetrically, at least one rotating shaft protruding from the side surface, a casing including at least one side portion corresponding to the side surface, and at least one protruding block. The side portion of the casing extends backward to form a rotating portion. The rotating portion is disposed with an elongated hole. A distance between an edge of the elongated hole and an edge of the rotating portion is substantially a fixed value. A distance between the protruding block and the rotating shaft is equal to or slightly larger than the fixed value. The rotating shaft urges against the edge of the elongated hole of the casing, and the protruding block urges against the edge of the rotating portion of the casing.

10 Claims, 8 Drawing Sheets

ELECTRICAL CONNECTOR

CROSS-REFERENCE TO RELATED APPLICATIONS

This non-provisional application claims priority under 35 U.S.C. §119(a) on Patent Application No. 201220040505.7 filed in P.R. China on Feb. 9, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electronic card connector capable of preventing scratching of a motherboard.

BACKGROUND OF THE INVENTION

Currently, a conventional electrical connector generally includes an insulating body and a casing. The insulating body is fixed to a motherboard, and two side surfaces of the insulating body are symmetrically disposed with two rotating shafts. The casing is slideably pivoted to the rotating shaft. The casing includes a cover, and two sides of the cover are respectively bent to form a side portion. The side portion includes a rotating portion. The rotating portion is disposed with an elongated hole and the elongated hole is slideably pivoted to the rotating shaft. The casing has an open state, a closed state and a fastened state.

The elongated hole is pivoted to the rotating shaft. When the casing is in the closed state, the casing has a slide stroke, so that the casing slides and is then fastened to the insulating body, so as to prevent the casing from being lifted freely. However, owing to the elongated hole, when the casing is in the open state, the casing may slide downward due to gravity, causing contact between the rotating portion and the motherboard. Once the contact occurs, the rotating portion scratches the motherboard during rotation of the casing.

Therefore, a heretofore unaddressed need exists in the art to address the aforementioned deficiencies and inadequacies.

SUMMARY OF THE INVENTION

In one aspect, the present invention is directed to an electrical connector, and more particularly to an electronic card connector capable of preventing a rotating portion from scratching a motherboard.

In one embodiment, an electrical connector for electrically connecting a mating element to a motherboard includes an insulating body, at least one rotating shaft, a casing, and at least one protruding block. The insulating body has two side surfaces disposed symmetrically. The at least one rotating shaft protrudes from the side surface and located at a rear end of the side surface. The casing includes at least one side portion corresponding to the side surface. The side portion extends backward to form a rotating portion. The rotating portion is disposed with an elongated hole. A distance between an edge of the elongated hole and an edge of the rotating portion is substantially a fixed value. A distance between the protruding block and the rotating shaft is equal to or slightly larger than the fixed value. The rotating shaft urges against the edge of the elongated hole, and the protruding block urges against the edge of the rotating portion, so that the rotating shaft and the protruding block jointly limit a trajectory of movement or rotation of the casing.

Further, the insulating body and the protruding block are integrally formed. Two sides of the insulating body are disposed with at least one narrow slot formed through an upper surface and a bottom surface of the insulating body. At least one iron sheet is fixed in the narrow slot by an interference fit, and the iron sheet is fixed to the motherboard. The iron sheet is disposed with a soldering portion, and the soldering portion is fixed to the motherboard by soldering. At least one stopping portion is disposed to limit an angle of rotation of the casing. The rotating shaft is disposed with a guide chamfer, and the width of the guide chamfer gradually increases along an insertion direction of the rotating portion. A rear end of at least one side of the insulating body is disposed with a boss corresponding to the rotating portion. A front end of the boss is disposed with a first chamfer, and a rear end of the boss is disposed with a second chamfer.

In another embodiment, the rotating shaft is formed by stamping a plate, and the plate has a catch portion for being fixed to the insulating body.

As compared with the related art, for the electrical connector according to the embodiments of the present invention, when the rotating portion rotates around the rotating shaft, the protruding block prevents the rotating portion from moving downward to contact the motherboard, thereby preventing scratching of the motherboard. The stopping portion limits the angle of rotation of the casing, so as to prevent the casing from contacting other elements on the motherboard, thereby preventing the casing from scratching other elements on the motherboard. The rotating shaft urges against the edge of the elongated hole, and the protruding block urges against the edge of the rotating portion, so that the rotating shaft and the protruding block jointly limit the trajectory of movement or rotation of the casing.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
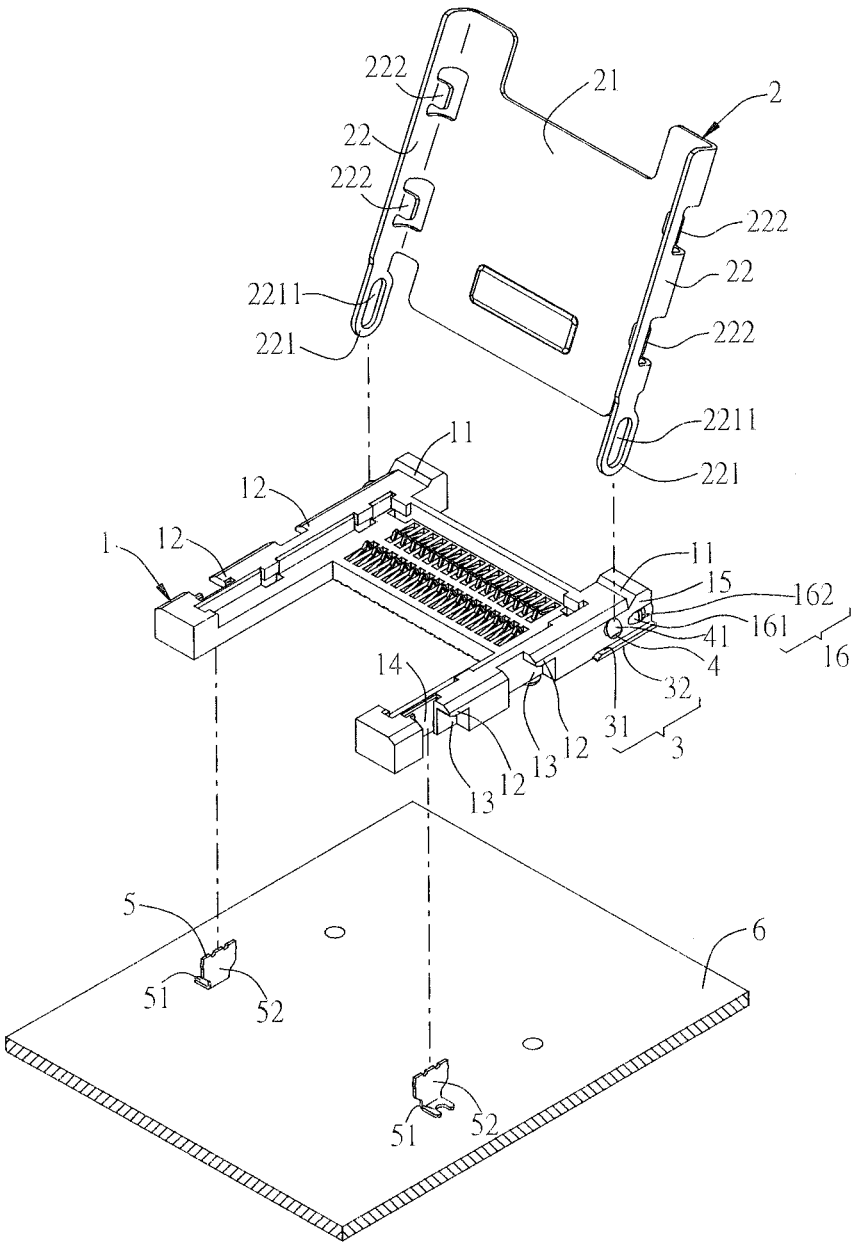
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
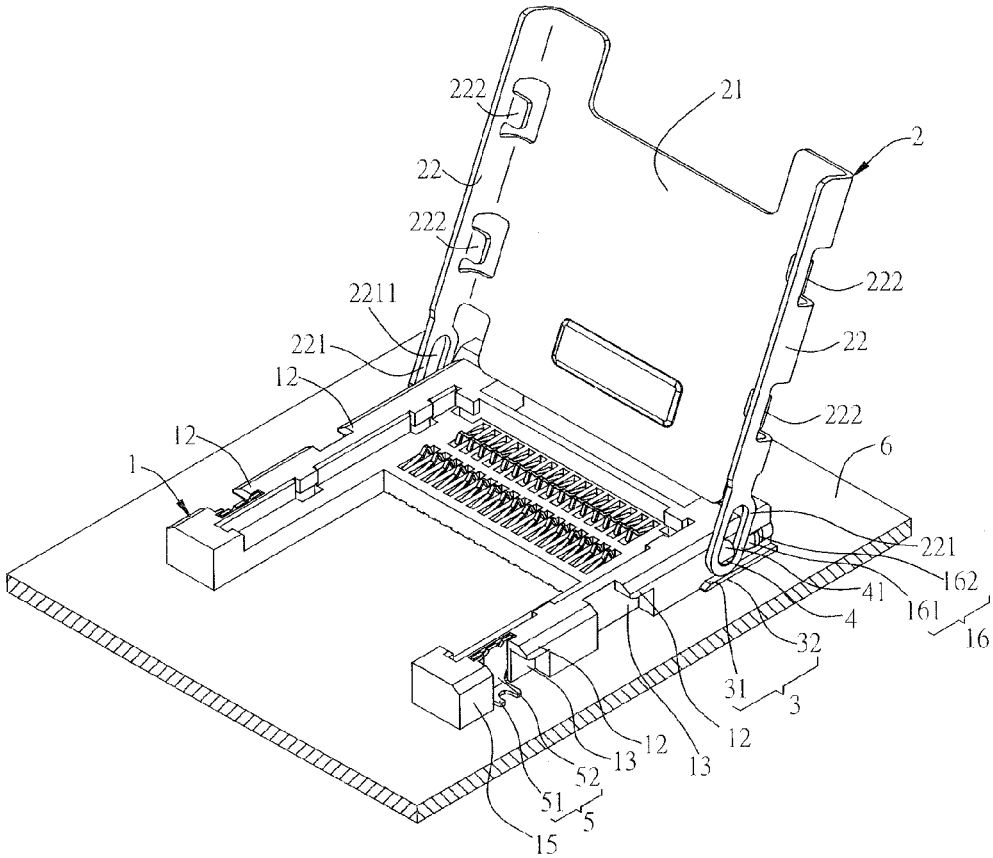
FIG. 2 is a schematic three-dimensional assembled view of the electrical connector according to one embodiment of the present invention when the casing is open.

Referring to FIGS. 1 and 2, the electrical connector according to one embodiment of the present invention for electrically connecting a mating element (not shown) to a motherboard 6 includes an insulating body 1 disposed on the motherboard 6, a casing 2 pivoted to the insulating body 1, two protruding blocks 3, two rotating shafts 4 pivoted to the casing 2, and two iron sheets 5. The insulating body 1 has two side surfaces 15 disposed symmetrically about a longitudinal central line of the insulating body 1. The two protruding blocks 3 urge against the side surface 15 and is located at the bottom of the side surface 15. The two rotating shafts 4 correspondingly protrude from the two side surfaces 15 and are located at rear ends of the two side surfaces 15. Each rotating shaft 4 is respectively located above a corresponding protruding block 3. The two iron sheets 5 are fixed to the motherboard 6 by soldering, and the two iron sheets 5 is fixed in the insulating body 1.

Figure 7:
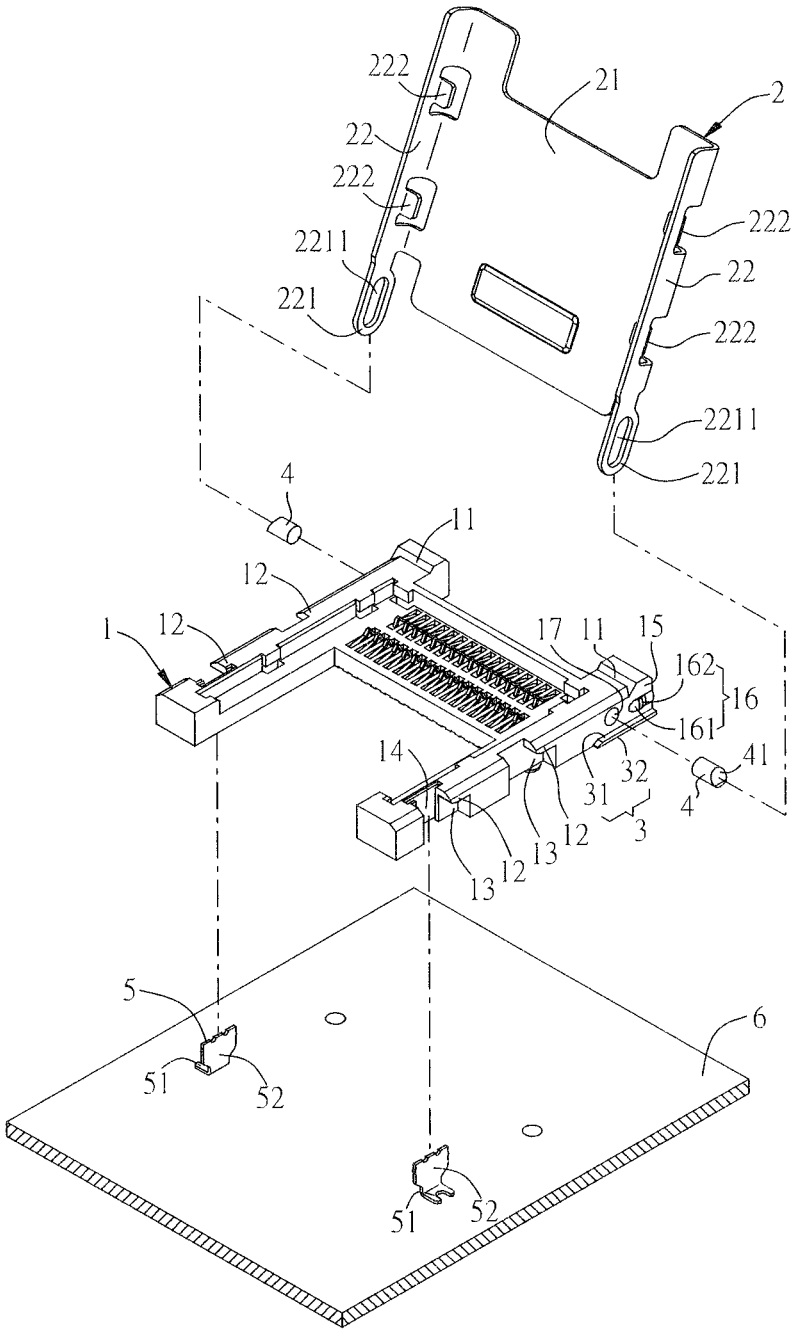
FIG. 7 is a schematic three-dimensional exploded view of a first embodiment of the electrical connector of the present invention.

Referring to FIGS. 1 and 2, one rotating shaft 4 protrudes from each of the two side surfaces 15, and the rotating shafts 4 are respectively located at the rear ends of the two side surfaces 15, and the rotating shaft 4 and the insulating body 1 are integrally formed. In other embodiments, referring to FIG. 7, the rotating shaft 4 may also be made of metal or other composite materials having high hardness, so as to prevent the wearing or breakage of the rotating shaft 4 by the long time rotation of pivoted casing 2. The rotating shaft 4 is fixed in a recessed hole 17 of the insulating body 1 by an interference fit or is insert-molded in the insulating body 1. Each rotating shaft 4 is disposed with a guide chamfer 41, the width of the guide chamfer 41 gradually increases along an insertion direction of the casing 2, and the guide chamfer 41 is used for guiding the casing 2 to be pivoted to the rotating shaft 4 during mounting.

Referring to FIGS. 1 and 2, two stopping portions 11 are disposed on an upper surface of the insulating body 1. In other embodiments, the number of the stopping portion 11 is one or more. The two side surfaces 15 are respectively recessed with two fastening slots 13. In other embodiments, the number of the fastening slot 13 is one or more. A stopping block 12 is correspondingly disposed right above each fastening slot 13. Two sides of the insulating body 1 are respectively disposed with a narrow slot 14 formed through upper and lower surfaces of the two sides of the insulating body 1. Each narrow slot 14 correspondingly receives the iron sheet 5. The iron sheet 5 functions to fix the motherboard 6 and the insulating body 1. The iron sheet 5 is fixed in the narrow slot 14 by an interference fit. Each iron sheet 5 has a soldering portion 51 and a vertical portion 52, the soldering portion 51 is fixed to the motherboard 6 by soldering, and the vertical portion 52 is fixed to the narrow slot 14 by an interference fit. Rear ends of the two sides of the insulating body 1 are respectively disposed with a boss 16 correspondingly located behind the rotating shaft 4. The boss 16 and the insulating body 1 are integrally formed. A front end of the boss 16 is disposed with a first chamfer 161 and a rear end of the boss 16 is disposed with a second chamfer 162. In other embodiments, the rear end of only one side of the insulating body 1 is disposed with the boss 16 correspondingly located behind the rotating shaft 4.

Referring to FIGS. 1 and 2, the casing 2 includes a flat plate-shaped cover 21 covering on the insulating body 1. Two sides of the cover 21 are bent laterally to form two side portions 22 corresponding to the side surface 15. Each side portion 22 extends backward to form a rotating portion 221. The rotating portion 221 is disposes with an elongated hole 2211. The elongated hole 2211 and the rotating portion 221 extend in the same direction. The elongated hole 2211 is slideably pivoted to the rotating shaft 4. Each side portion 22 extends laterally and horizontally to form two fasteners 222, and each fastener 222 is corresponding to each fastening slot 13.

Referring to FIGS. 1 and 2, the electrical connector according to one embodiment of the present invention includes the two protruding blocks 3, and each protruding block 3 is correspondingly located below the boss 16. The protruding block 3 urges against an edge of the rotating portion 221, the rotating shaft 4 urges against an edge of the elongated hole 2211. A distance between the edge of the elongated hole 2211 and the edge of the rotating portion 221 is substantially a fixed value. A distance between the protruding block 3 and the rotating shaft 4 is equal to or slightly larger than the fixed value, so that the rotating shaft 4 and the protruding block 3 jointly limit a trajectory of movement or rotation of the rotating portion 221. The two protruding blocks 3 are made of plastic. The two protruding blocks 3 and the insulating body 1 are integrally formed. The two protruding blocks 3 urge against the side surface 15 and are located below the rotating portion 221. Each protruding block 3 has an upper plane 31 and a lower plane 32. The upper plane 31 supports the rotating portion 221, and the lower plane 32 contacts an upper surface of the motherboard 6. In other embodiments, the two protruding blocks 3 may also be made of metal, and insert-molded in the insulating body 1.

Figure 3:
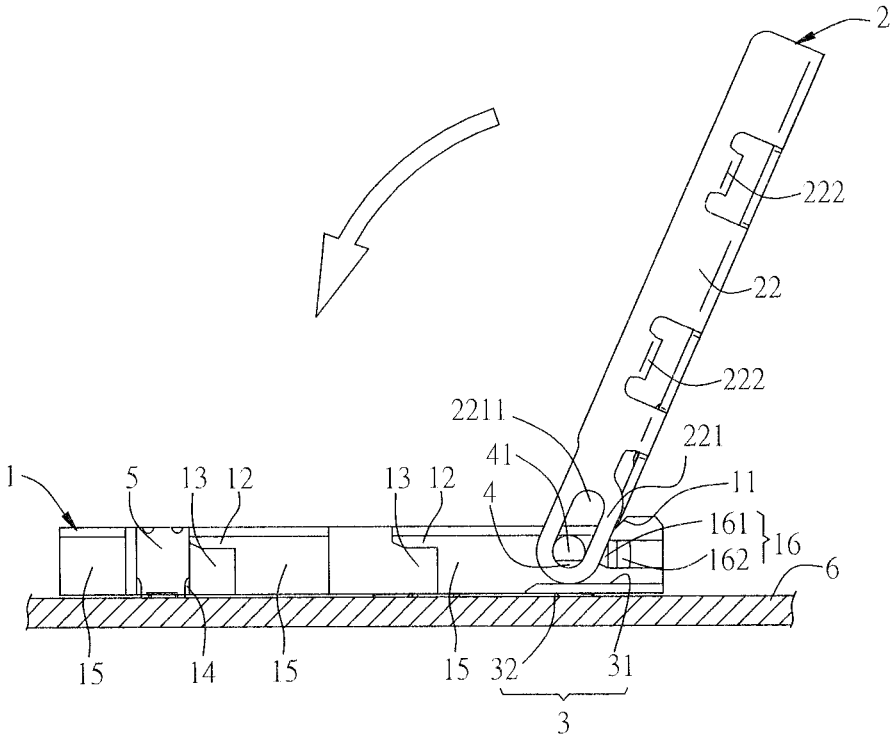
FIG. 3 is a schematic side view of FIG. 2.
Figure 4:
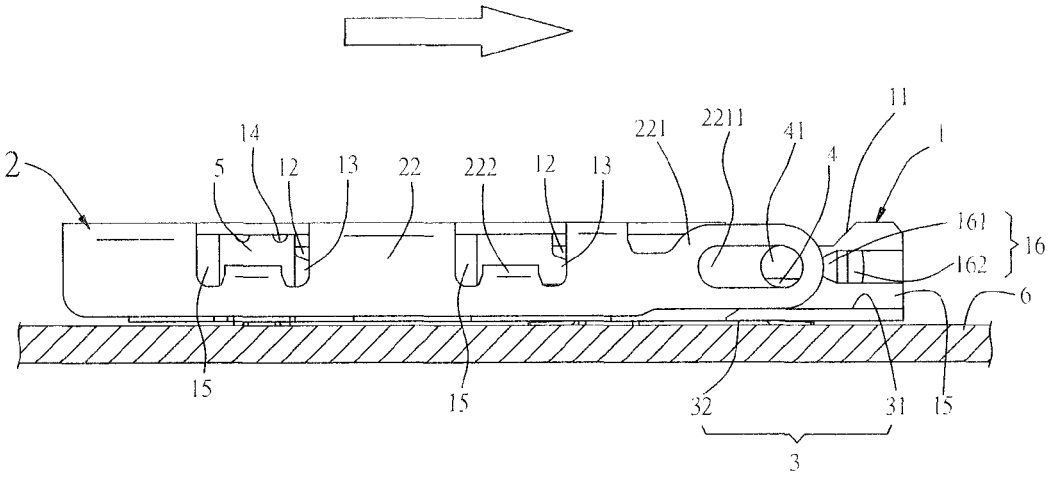
FIG. 4 is a schematic side view of the electrical connector according to one embodiment of the present invention when the casing is closed.

Referring to FIGS. 2-4, the insulating body 1, the protruding block 3 and the rotating shaft 4 are integrally formed. During mounting, first, the iron sheet 5 is fixed in the narrow slot 14 by an interference fit, so that the iron sheet 5 is fixed to the insulating body 1. Then, the soldering portion 51 is soldered to the motherboard 6, so that the iron sheet 5 is fixed to the motherboard 6. Next, the casing 2 is mounted by pivoting the rotating portion 221 to the rotating shaft 4, so as to enable the casing 2 to rotate relative to the insulating body 1. When the cover 21 is press-fit to the mating element (not shown), the mating element (not shown) is electrically connected to the motherboard 6. To mount the casing 2 and the insulating body 1 more easily, the rotating shaft 4 is disposed with the guide chamfer 41 for guiding the rotating portion 221 to be pivoted to the rotating shaft 4, and the protruding block 3 is disposed with the upper plane 31 for supporting the rotating portion 221, so as to prevent the rotating portion 221 from contacting the motherboard 6 downward, thereby preventing scratching the motherboard 6. As the protruding block 3 also can limit the rotating portion 221 from sliding downward, the elongated hole 2211 and the rotating shaft 4 are maintained at the same center of rotation during opening and closing rotation of the casing 2. To prevent an excessively large angle when the casing 2 is in an open state, the stopping portion 11 is disposed to stop the casing 2, thereby preventing the casing 2 from rotating at an excessively large angle to contact other elements on the motherboard 6.

Figure 5:
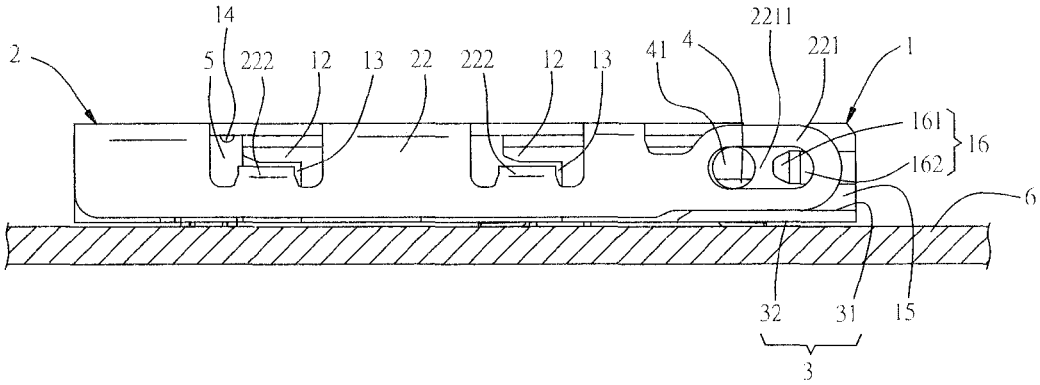
FIG. 5 is a schematic side view of the electrical connector according to one embodiment of the present invention when the casing is fastened.
Figure 6:
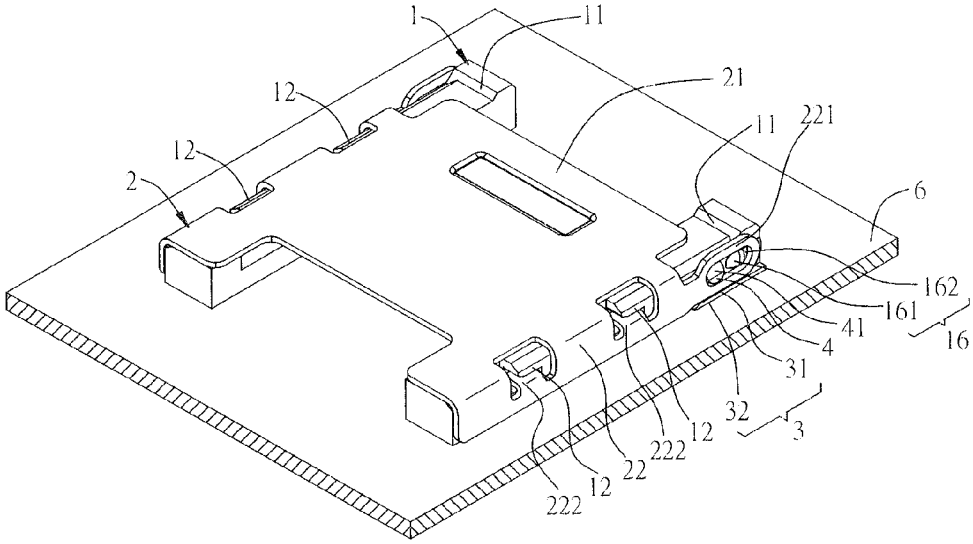
FIG. 6 is a schematic three-dimensional assembled view according to one embodiment of the electrical connector of the present invention.

Referring to FIGS. 4-6, as the elongated hole 2211 is pivoted to the rotating shaft 4 to provide a slide stroke, the casing 2 in a closed state can move horizontally forward and backward. When the casing 2 shifts backward from the closed state to a fastened state, the fastener 222 is completely received in the fastening slot 13. Each stopping block 12 correspondingly stops each fastener 222 to prevent the casing 2 from being lifted. The boss 16 is buckled in the elongated hole 2211 to limit sliding of the casing 2, which can prevent the casing 2 from being easily disengaged under an external force. The boss 16 is further disposed with the first chamfer 161 for guiding the rotating portion 221. The second chamfer 162 is disposed relative to the first chamfer 161 to guide the rotating portion 221 to exit the fastened state.

Figure 8:
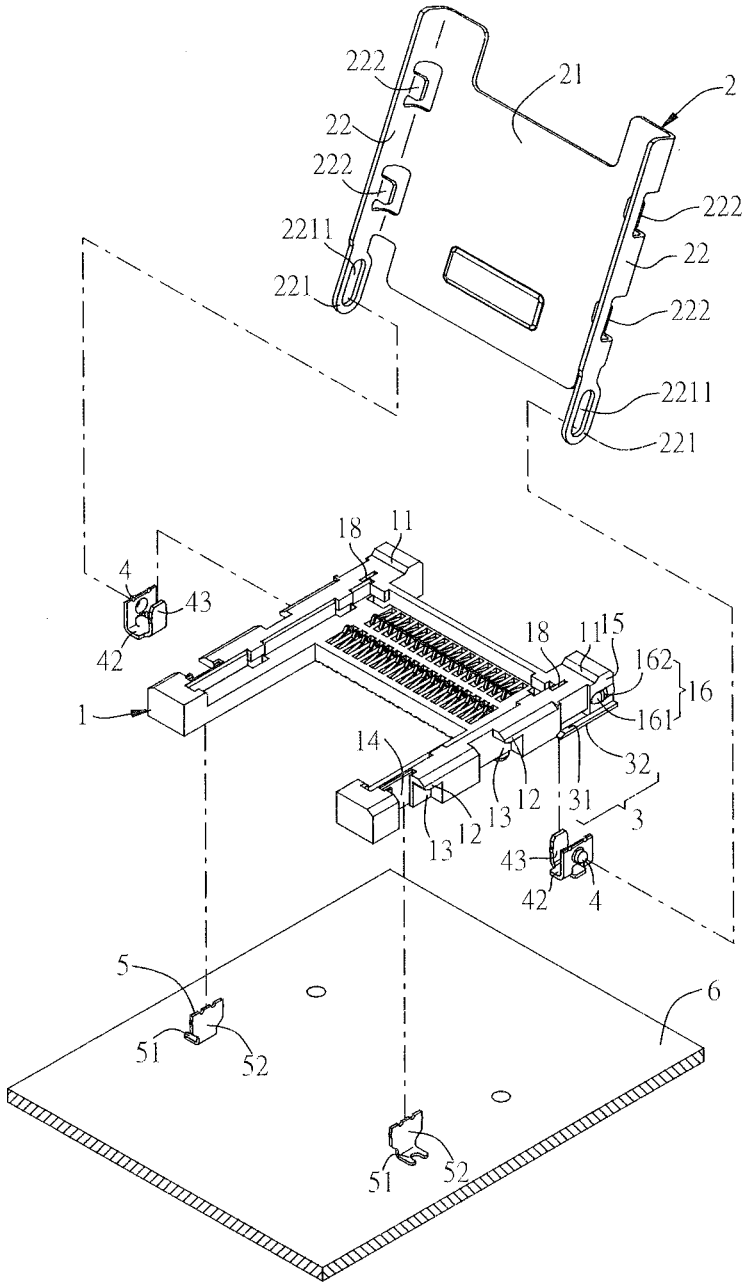
FIG. 8 is a schematic three-dimensional exploded view of a second embodiment of the electrical connector of the present invention.

FIG. 8 shows a second embodiment of the electrical connector of the present invention, in which the rotating shaft 4 is formed by stamping a plate 42. One end of the plate 42 is the rotating shaft 4, and the other end of the plate 42 forms a catch portion 43. The plate 42 may be made of metal or other composite materials having high hardness, so as to prevent the wearing or breakage of the rotating shaft 4 by the long time rotation of pivoted casing 2. A slot hole 18 is formed through the insulating body 1 corresponding to the catch portion 43, and is used for fixing the catch portion 43 by an interference fit. After the catch portion 43 is mounted in the slot hole 18, the rotating shaft 4 can be pivoted to the elongated hole 2211 of the casing 2 to achieve opening and closing movement. As the rotating shaft 4 is located above the protruding block 3, the casing 2 in the closed state can also be enabled to move laterally backward to enter the fastened state, so as to prevent the casing 2 from being lifted.

Based on the above description, the electrical connector of the present invention, among other things, has the following beneficial effects.

1. When the rotating portion 221 rotates around the rotating shaft 4, the upper plane 31 of the protruding block 3 supports the rotating portion 221 to prevent the rotating portion 221 from moving downward to contact the motherboard 6, thereby preventing scratching the motherboard 6.

2. The rotating shaft 4 urges against the edge of the elongated hole 2211, and the protruding block 3 urges against the edge of the rotating portion 221, so that the rotating shaft 4 and the protruding block 3 jointly limit the trajectory of movement or rotation of the casing 2.

3. The stopping portion 11 limits the angle of rotation of the casing 2, so as to prevent the casing 2 from contacting other elements on the motherboard 6, thereby preventing the casing 2 from scratching other elements on the motherboard 6.

4. The guide chamfer 41 of the rotating shaft 4 guides the rotating portion 221 to be pivoted to the rotating shaft 4, so that the casing 2 and the insulating body 1 can be mounted more easily.

5. When the casing 2 is in the fastened state, the boss 16 is buckled in the elongated hole 2211 to limit sliding of the casing 2, which can prevent the casing 2 from being easily disengaged under an external force.

In different embodiments, the number of the protruding block 3 is the same as that of the rotating shaft 4, and the numbers of the protruding block 3, the rotating shaft 4, the iron sheet 5 and the stopping portion 11 may all be one or more.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, for electrically connecting a mating element to a motherboard, comprising:

(a) an insulating body, having two side surfaces disposed symmetrically;

(b) at least one rotating shaft, protruding from the side surface and located at a rear end of the side surface;

(c) a casing, comprising at least one side portion corresponding to the side surface, wherein the side portion extends backward to form a rotating portion, the rotating portion is disposed with an elongated hole, and a distance between an edge of the elongated hole and an edge of the rotating portion is substantially a fixed value; and (d) at least one protruding block, wherein a distance between the protruding block and the rotating shaft is equal to or slightly larger than the fixed value, the rotating shaft urges against the edge of the elongated hole, and the protruding block urges against the edge of the rotating portion, so that the rotating shaft and the protruding block jointly limit a trajectory of movement or rotation of the casing.

2. The electrical connector according to claim 1, wherein the insulating body and the protruding block are integrally formed.

3. The electrical connector according to claim 1, wherein at least one stopping portion is disposed to limit an angle of rotation of the casing.

4. The electrical connector according to claim 1, wherein the rotating shaft is formed by stamping a plate, and the plate has a catch portion for being fixed to the insulating body.

5. The electrical connector according to claim 1, wherein two sides of the insulating body are disposed with at least one narrow slot formed through an upper surface and a bottom surface of the insulating body.

6. The electrical connector according to claim 5, wherein at least one iron sheet is fixed in the narrow slot by an interference fit, and the iron sheet is fixed to the motherboard.

7. The electrical connector according to claim 6, wherein the iron sheet is disposed with a soldering portion, and the soldering portion is fixed to the motherboard by soldering.

8. The electrical connector according to claim 1, wherein a rear end of at least one side of the insulating body is disposed with a boss corresponding to the rotating portion.

9. The electrical connector according to claim 8, wherein a front end of the boss is disposed with a first chamfer.

10. The electrical connector according to claim 8, wherein a rear end of the boss is disposed with a second chamfer.

* * * * *